US007142111B2

(12) United States Patent
Eskildsen et al.

(10) Patent No.: US 7,142,111 B2
(45) Date of Patent: Nov. 28, 2006

(54) METHOD OF PROGRAMMING SECURITY CONTROL PANELS FOR DOOR ENTRY DEVICE COMPATIBILITY

(75) Inventors: Kenneth G Eskildsen, Great Neck, NY (US); Hong Jyh Chen, Woodbury, NY (US)

(73) Assignee: Honeywell International, Inc., Morristown, NJ (US)

( * ) Notice: Subject to any disclaimer, the term of this patent is extended or adjusted under 35 U.S.C. 154(b) by 240 days.

(21) Appl. No.: 10/958,066

(22) Filed: Oct. 4, 2004

(65) Prior Publication Data

US 2005/0046564 A1 Mar. 3, 2005

Related U.S. Application Data

(63) Continuation-in-part of application No. 10/462,449, filed on Jun. 16, 2003, now Pat. No. 6,963,280.

(51) Int. Cl.
*E05B 45/06* (2006.01)

(52) U.S. Cl. ..... 340/542; 340/506; 340/527; 340/545.1; 340/825.52

(58) Field of Classification Search ..... 540/506
See application file for complete search history.

(56) References Cited

U.S. PATENT DOCUMENTS 5,311,168 A * 5/1994 Pease et al. ..... 340/542
5,801,625 A * 9/1998 Wang ..... 340/506
6,225,903 B1 * 5/2001 Soloway et al. ..... 340/542
6,346,889 B1 * 2/2002 Moss ..... 340/686.1
6,690,276 B1 * 2/2004 Marino ..... 340/539.1
6,812,836 B1 * 11/2004 Soloway et al. ..... 340/542
6,930,604 B1 * 8/2005 Marino ..... 340/539.16
6,987,450 B1 * 1/2006 Marino et al. ..... 340/539.22

* cited by examiner

*Primary Examiner*—Daniel Wu
*Assistant Examiner*—George Bugg
(74) *Attorney, Agent, or Firm*—Anthony R. Barkume, P.C.

(57) ABSTRACT

A method of operating a control panel in a security system that includes a door entry security device in a housing suitable for mounting within a recess of a doorjamb or door of a premises. The control panel is programmed to register a system arm/disarm device and a door closure device, both with the same identification number, such that the control panel recognizes that identification number to be associated with a door entry security device. In the even that the control panel receives, while in an armed state, an alarm signal from a security device in the security system and then receives a system disarm message, then the control panel determines if the system disarm message was received from a system arm/disarm device that has been registered as a door entry security device. If the control panel determines that the system disarm message was received from a system arm/disarm device that has been registered as a door entry security device, then the system disarm message is ignored; and if the control panel determines that the system disarm message was not received from a system arm/disarm device that has been registered as a door entry security device, then the system disarm message is followed.

8 Claims, 7 Drawing Sheets

METHOD OF PROGRAMMING SECURITY CONTROL PANELS FOR DOOR ENTRY DEVICE COMPATIBILITY

CROSS-REFERENCE TO RELATED APPLICATIONS

This application is a continuation-in-part application of application Ser. No. 10/462,449 filed Jun. 16, 2003 now U.S. Pat. No. 6,963,280 and owned by the assignee of this application, the specification of which is incorporated by reference herein.

TECHNICAL FIELD

This invention relates to security systems, and in particular to a security device that operates in conjunction with an entry door to selectively arm and/or disarm the security system in an automatic manner and a method of operation of the security system and control panel utilizing this security device.

BACKGROUND ART

Alarm systems monitor sensors to determine the presence of people within a protected space. If the alarm system detects a breach of the protected space it will respond based on the state of the system. Possible system states include "disarmed", "armed stay", and "armed away." If the system is disarmed it will not cause an alarm due to a breach of perimeter or interior sensors. If the system is armed stay, it will alarm due to a breach of the perimeter sensors, but not due to a breach the interior sensors. If the system is armed away it will alarm based on a breach of the perimeter or interior sensors. The state of the system is determined by the needs of the occupants of the premises. If all of the occupants are leaving the premises then the system should be armed away. If the occupants will be staying within the premises for an extended period of time then the system should be armed stay. For all other scenarios the system should be disarmed.

Problems arise when the system is not properly armed and disarmed. Typical problems include not disarming the system before the alarm sounds, arming away when occupants plan to stay within the protected space, and not arming the system when the premises are unoccupied. These are user created problems and as such, it is desirable to develop a system that will assist the end user with the arming and disarming operations.

Others have attempted to provide partial improvement by offering security systems that will assist the end user with arming and disarming. One such system, as described in U.S. Pat. No. 6,225,903, is armed and disarmed by the action of the deadbolt on the entry door. A switch is mounted in the doorjamb to detect when the bolt is extended into the jamb, i.e. locked. If the deadbolt is locked and the alarm system does not detect motion within a predetermined exit time, then the system will transition to the armed away state. If motion is detected then it will transition to the armed stay state. If the system is armed and the deadbolt is unlocked, then the system will transition to the disarmed state. A major drawback with this arrangement occurs when the door is forced open (i.e. a "kick-in" by an intruder) and the bolt disengages from the jamb switch without the use of a key. Although this is an unauthorized entry, the alarm system will disarm allowing the perpetrator full access to the premises. Another major drawback with this arrangement is that the deadbolt switch needs to be wired to the control panel. This involves drilling into the jamb, removing the door casing, and fishing the wire to a basement or attic. As such, this is a labor-intensive installation that needs improvement.

Co-pending U.S. patent application Ser. No. 10/462,449 filed Jun. 16, 2003 and owned by the assignee of this application, relates to a door entry security device used in a security system including a control panel, the door security device in a housing suitable for mounting within a recess of a doorjamb or door of a premises. In the housing is a lock position detecting switch, adapted to detect the position of a lock mounted on a door as being either locked or unlocked, a door position detecting switch adapted to detect the position of the door as being either open or closed, and processing circuitry adapted to generate a security system disarm signal when (1) the position of the lock has transitioned from a locked state to an unlocked state, (2) the door is closed at the time that a predefined time period has elapsed since the position of the lock transitions from a locked state to an unlocked state, and (3) the door has been opened after that predefined time period has elapsed. The door entry device also has a data transmitter for sending the security system disarm signal to the control panel. An alarm signal is generated and transmitted to the control panel when the door is open at the time that the predefined time period has elapsed since the lock has transitioned to an unlocked state. The control panel prevents the security system from being disarmed when an alarm signal is received unless a user code is entered into the security system.

The present application relates to the '449 application and provides a methodology for the security system to implement in conjunction with this new security system device, and in particular provides a method of operation of the control panel with the new security system device.

DISCLOSURE OF THE INVENTION

The present invention therefore pertains to a method of operation of a security system control panel that interfaces with a security system arming and disarming arrangement that implements a wireless door security device. The wireless door security device is mounted in the doorjamb (or door) of an entryway of the premises to be protected and is used to monitor the condition of the door. The door security device has a contact switch to monitor when the deadbolt (or other type of door lock) is locked or unlocked, and it has a magnetic reed switch to monitor when the door is opened or closed. These two inputs are monitored by a microcontroller to determine that the sequence that occurs when the door is opened or closed is consistent with a normal entry or exit. For example, the deadbolt should be unlocked before the door is opened. If the door and the deadbolt open the same time (or within a certain short predefined time) then the door is considered to have been pried or kicked open. Based on the sequence detected by the microcontroller, an RF transmission will be sent to the control panel directing it to arm, disarm, or alarm. The security console is used to modify the arming operation. By pressing a single button on the console, the user can direct the security system to arm stay or arm away when receiving the arming command from the wireless sensor.

The control panel is programmed to register a system arm/disarm device and a door closure device, both with the same identification number, such that the control panel recognizes that identification number to be associated with a door entry security device. In the even that the control panel receives, while in an armed state, an alarm signal from a security device in the security system and then receives a system disarm message, then the control panel determines if the system disarm message was received from a system arm/disarm device that has been registered as a door entry security device. If the control panel determines that the system disarm message was received from a system arm/disarm device that has been registered as a door entry security device, then the system disarm message is ignored; and if the control panel determines that the system disarm message was not received from a system arm/disarm device that has been registered as a door entry security device, then the system disarm message is followed.

This arrangement solves the assisted security system interface problem in several ways. It provides a means to arm and disarm the security system with a minimum of intervention from the end user. It provides a means to ensure that the system is armed when needed, eliminating the unoccupied and unarmed premises problem. It provides a means to reliably disarm the system to eliminate entry delay false alarms. It also provides a means to detect forced entry and sound the alarm instead of disarming like those in the prior art.

The present invention effectively provides a means for assisted arming and disarming of security panels consistent with the functional requirements of these systems in contrast with prior art systems which compromise the scope of assisted security system arming.

Thus, the present invention is a method of operating a security system by first programming a control panel in the security system to accept messages from a system arm/disarm device associated with an identification number, and also programming the control panel to accept messages from a door closure device associated with the same identification number. As a result, the control panel will register the identification number as being associated with a door entry security device of the present invention. During operation and while in an armed state, the control panel receives an alarm signal from a security device in the security system, and a system arm/disarm device transmits a system disarm message to the control panel. The control panel determines if the system disarm message was received from a system arm/disarm device that has been registered as a door entry security device. The control panel will ignore the system disarm message from the system arm/disarm device if the control panel determines that the system disarm message was received from a system arm/disarm device that has been registered as a door entry security device.

BEST MODE FOR CARRYING OUT THE INVENTION

Figure 1:
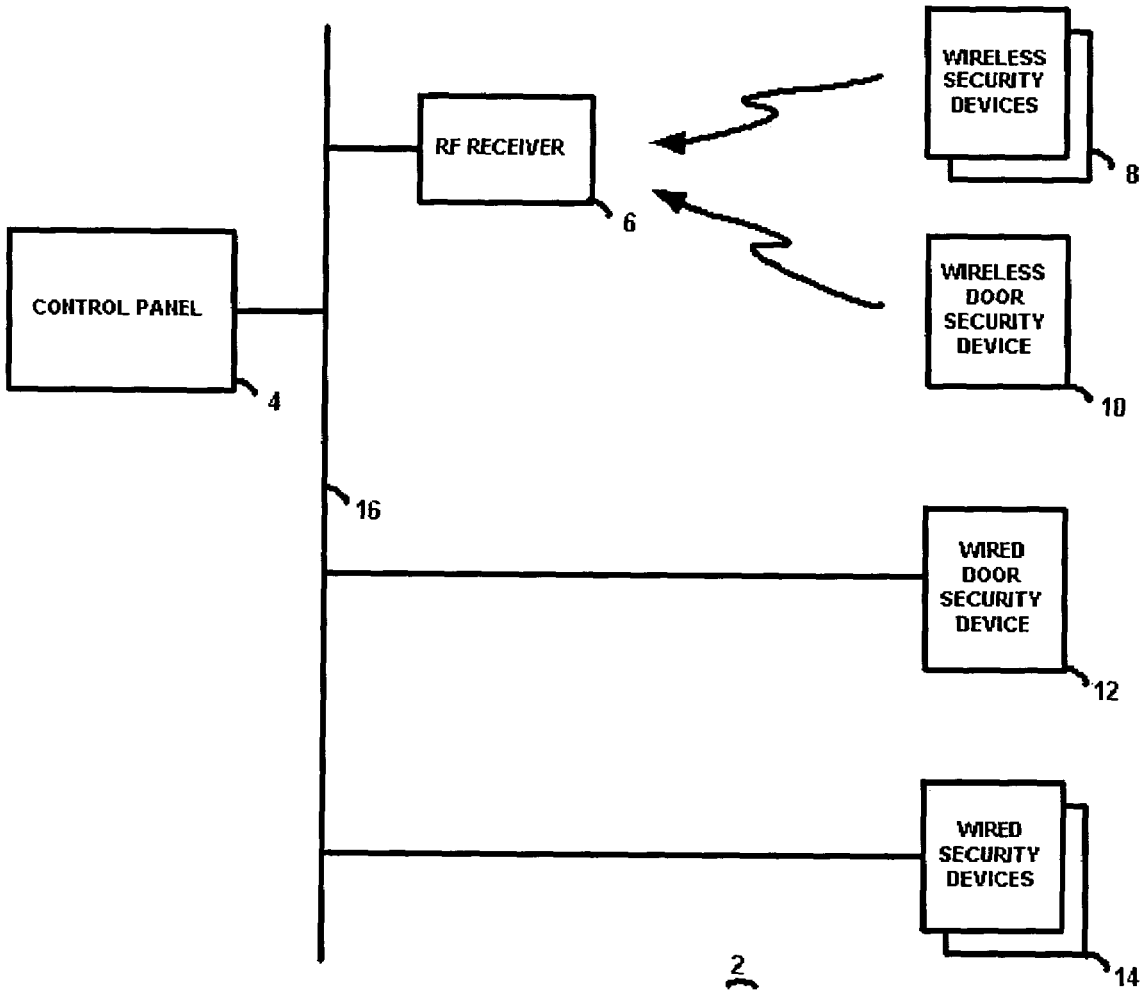
FIG. 1 is a block diagram of the door entry security device used with the present invention.

The preferred embodiment of the present invention will now be described with respect to the Figures. As also described in co-pending application Ser. No. 10/462,449 and repeated herein for clarity, FIG. 1 illustrates a block diagram of a security system 2 having a control panel 4 connected by a security system bus 16 to one or more wired security devices 14 as well known in the art. Security devices 14 may include, for example, a passive infrared (PIR) sensor for sensing motion of a protected volume of space, a smoke or heat detector, a glass break sensor, and the like. In addition, an RF receiver 6 is connected to the control panel 4, and provides wireless communications with wireless security devices 8 as well known in the art. These wireless security devices may also be PIR sensors, glass break sensors, etc. The control panel 4 operates as known in the art (except as modified in accordance with the present invention to inter-operate with the door security devices described herein), including processing of alarm signals from the various security devices, arming the system, disarming the system, providing system status, etc.

Also shown in FIG. 1 are a wireless door security device 10 and a wired door security device 12, which differ only in the manner that they communicate with the control panel 4 (i.e. the wireless door security device communicates by wireless link to RF receiver 6 and the wired door security device communicates by wired bus 16). These devices will therefore be referred to generically as door security devices throughout this specification. A security system may have one door security device, or it may have a plurality of such devices, with each located strategically at a selected entry door of the premises being monitored.

Figure 2:
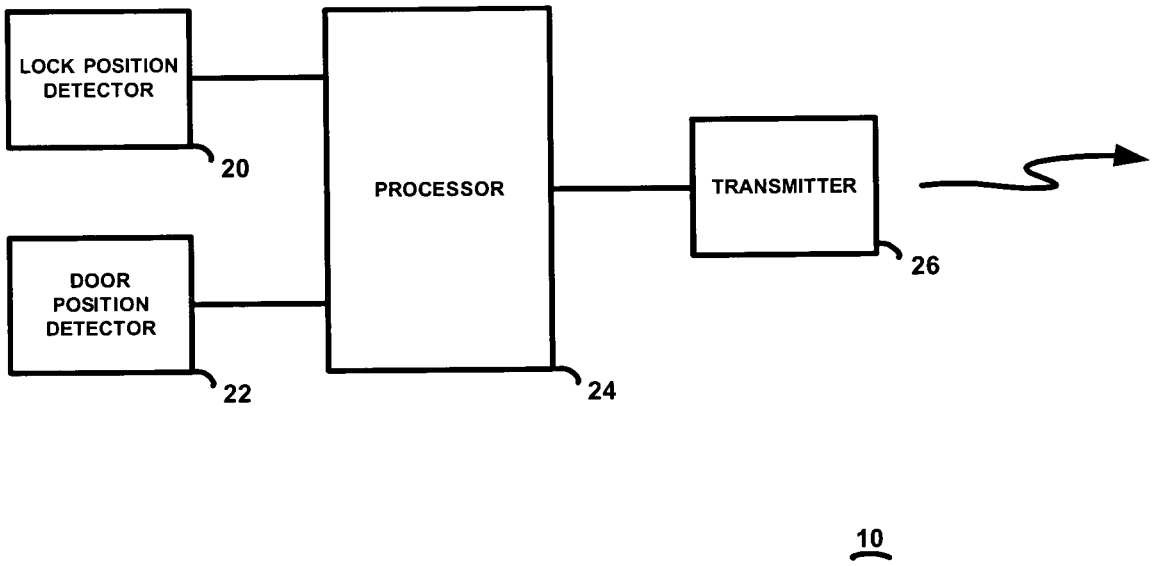
FIG. 2 is a detailed block diagram of the door entry security device of FIG. 1.
Figure 3:
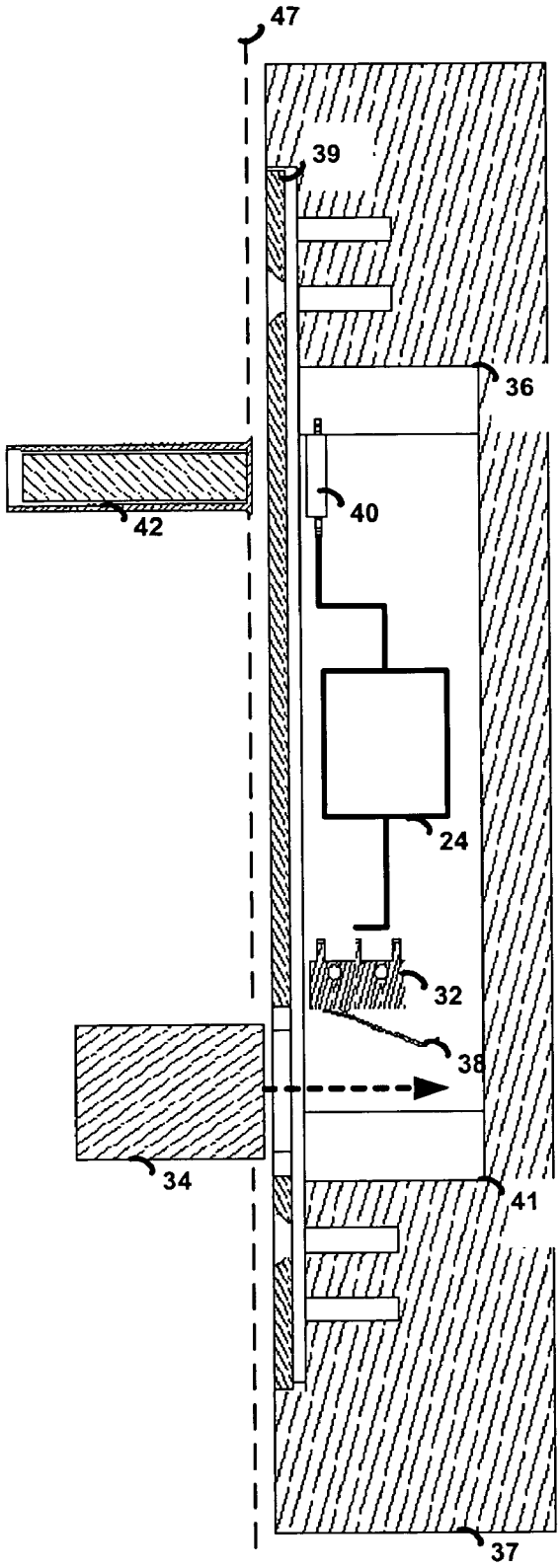
FIG. 3 is an illustration of the door entry security device mounted in a doorjamb.

A block diagram of the door security device is illustrated in FIG. 2. The major components of the door security device are a lock position detector 20, a door position detector 22, processing circuitry 24, and a data transmitter 26, which may be an RF wireless transmitter or a wired transmitter as previously explained. As shown in FIG. 3, these components are suitably mounted within a housing 36 that is preferably adapted to fit within a recess of a doorjamb 37, in particular within the recess 41 otherwise occupied by a bolt cup and strike plate 39 as shown in FIG. 3. Thus, in the preferred embodiment, the door security device may be obtained and inserted in the pre-existing recess of a doorjamb as a retrofit by an installer or by a homeowner. If a wireless door security device 10 is used, then no further wiring is necessary. If a wired door security device 12 is used, then the installer must also run a wire(s) from the housing 36 to the bus 16 as known in the art. Thus, the preferred embodiment utilizes a wireless transmitter for ease of installation in the doorjamb. In an alternative embodiment, the door security device is mounted in the door itself rather than the doorjamb. The present invention has applicability in both the doorjamb-mounted and the door-mounted embodiments.

The lock position detector 20 may operate to determine the position of a deadbolt or of a standard entry lock, as desired by the user. That is, by simply mounting the housing in the desired doorjamb recess, the security system may be controlled by the selected door lock mechanism. The door lock may be key operated, swipe card, combination lock, etc. In the preferred embodiment, the device is used to sense the position of a deadbolt since using it with a standard entry lock recess would arm the system every time the door is closed (as described below).

The lock position detector, as shown in FIG. 3 in the preferred embodiment, is a mechanical contact switch 32 that is well known in the art and can sense the presence of the bolt 34 within the housing 36 (i.e. detect if the lock is locked or unlocked). The housing 36 receives the bolt 34 as it is extended by operation of the locking mechanism on the door 47 into the locked position. When the bolt is in the locked, or extended, position, then the arm 38 on the contact switch 32 is caused to close, and a DOOR LOCKED signal is generated by the contact switch 32 and input to the processor 24. When, however, the bolt is retracted into the door (or otherwise leaves the housing 36, which may be by forced entry), then the arm 38 opens and the DOOR LOCKED signal changes state to DOOR UNLOCKED, which is input to the processing circuitry 24. For example, the DOOR UNLOCKED signal may be an interrupt to a microprocessor that will cause it to enter certain processing routines as further described. Thus, the transition of the bolt from a retracted state (unlocked) to an extended state (locked) is communicated to the processor 24, as is the transition of the bolt from an extended state (locked) to a retracted state (unlocked). Other types of position detecting mechanisms may be used to detect the position of the bolt in addition to the contact switch embodiment described herein, such as a magnetic reed switch, optical detectors, etc.

The door position detector, in the preferred embodiment, is also mounted within the housing 36 to provide a status signal that indicates if the door is closed (substantially aligned with the doorjamb) or open with respect to the doorjamb. A magnetic reed switch mechanism 40 may be used, for example, to provide such status signals. A magnet 42 is located within the door 47 so that it causes the reed switch 40 to change states when the door is brought into substantial alignment with the doorjamb as well known in the art. Thus, when the door is closed in the doorjamb, then a DOOR CLOSED signal is generated by the reed switch 40 and sent to the processing circuitry 24. Correspondingly, when the door is opened, the DOOR CLOSED signal changes state to DOOR OPEN, which is input to the processor. For example, the DOOR OPEN signal may be an interrupt to a microprocessor that will cause it to enter certain processing routines as further described. Other types of door position detecting mechanisms may be used to detect the position of the door in addition to the reed switch embodiment described herein.

Note that although the preferred embodiment uses a single signal (with 2 states) to indicate the status of the door latch (and one for the door position), other types of signals may be used (i.e. discrete lines for each state) as well.

In distinction to the prior art systems described above, in which alarm systems are armed or disarmed simply on the position of the deadbolt, the present invention utilizes intelligence to analyze the position of the lock as well as the position of the door and then control the security system in a more secure and robust manner as now described.

Figure 4:
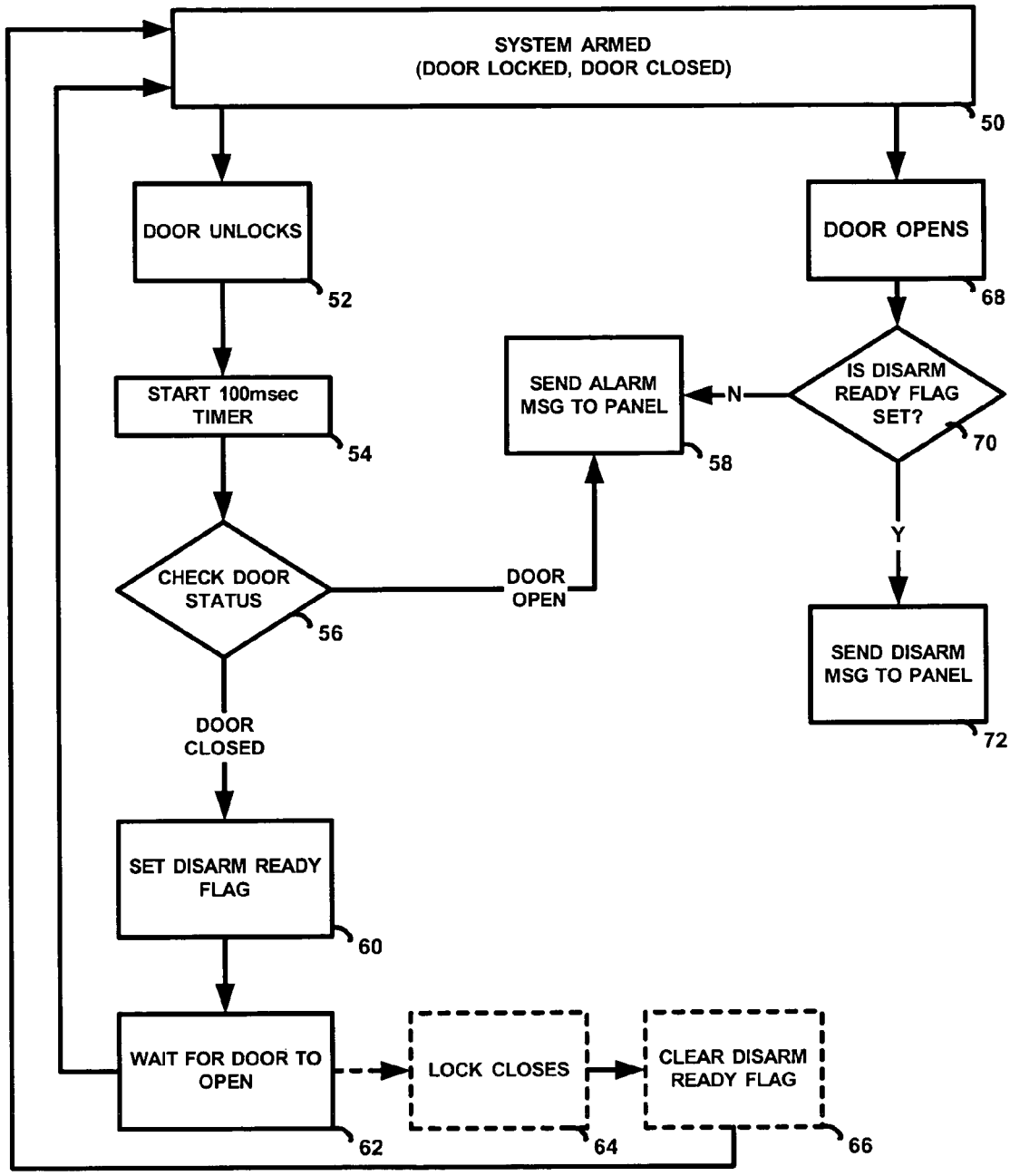
FIG. 4 is a flowchart of the disarm operation of the door entry security device.

With respect to FIG. 4, in the first scenario, the security system is in the armed state (step 50), which means that the activation of any of the security devices 8, 10, 12, 14 will generally cause an alarm signal to be generated, and certain defined actions to be taken (such as sounding a siren, dialing a central station, etc.). One feature of the present invention is to allow the opening of the door monitored by the door security device to automatically disarm the security system, as long as it has been preceded by the opening of the lock in an appropriate manner, i.e. for at least a certain predetermined time. In this manner, a "kick-in" of the door will not cause the system to disarm, but would instead sound the alarm, which is advantageous over the prior art.

First, at step 52, the processor 24 will receive the DOOR UNLOCKED interrupt from the lock position detector 20 that indicates that the door has been unlocked; i.e. that it has transitioned from the locked state to the unlocked state. The processor will start a timer process at step 54 and count down a predetermined time, which in the preferred embodiment is 100 msec. At the expiration of the 100 msec period, the door status signal is checked at step 56 to verify that the door is still closed (DOOR CLOSED STATE). Note that if an intruder has forced open the door, then the door status will indicate door open at or about the same time (i.e. within 100 msec) as the lock position being sensed as retracted (the bolt exiting the housing in the doorjamb, or DOOR UNLOCKED state), and the processor will sound the alarm in this event. This forced entry disarm prevention is not found in the prior art. In addition, the 100 msec delay is useful in debouncing the switch and ensuring that transient signals are not falsely detected.

Assuming that the door is still closed after the 100 msec window has expired (DOOR CLOSED state), then the processor will set a "DISARM READY" flag at step 60, but will not disarm the security system at that time. Instead, the processor will wait (step 62 and 50) for the door status to change from closed to open (step 68), and then check the state of the DISARM READY flag (step 70). If the flag is set, then the processor will issue a system disarm message, which will be sent by the transmitter 26 to the control panel (step 72), which will operate on it in the normal course of procedure. If, however, the flag has been cleared (step 66) before the door is opened, then the processor will not disarm the system but instead would send an alarm message (step 58). This may occur if a person turns the key to retract a deadbolt, for example, and then changes his or her mind and re-locks the door without opening it (step 64). Since turning the key to retract the deadbolt will set the DISARM READY flag (after 100 msec), a subsequent forced entry of the door in this scenario would disarm the system if the flag weren't cleared by the re-locking of the door by the user. Thus, implementation of the disarm ready flag is another safety measure in the present invention.

When the lock status changes to indicate that the lock has been retracted (DOOR UNLOCKED) (step 52), and the door status indicates that the door is open at the time that the 100 msec period has elapsed (DOOR OPEN) (step 56), then the system will not disarm and, instead, an alarm message is generated and transmitted to the control panel for processing (step 58). The control panel will then not allow disarming of the system via any door security lock in the system, but preferably will require the entry of a user code on a keypad or remote keyfob, which will transmit the user code to the control panel and then disarm the system. Since an intruder might kick in the door and then attempt to open another door from inside having a door security lock in order to disarm the system (which would be an easy task from the inside), the control panel will ignore disarm messages from a door security device when it has been alarmed (by any security device in the system). This is accomplished in the following manner, in accordance with the invention of the present application.

Figure 6:
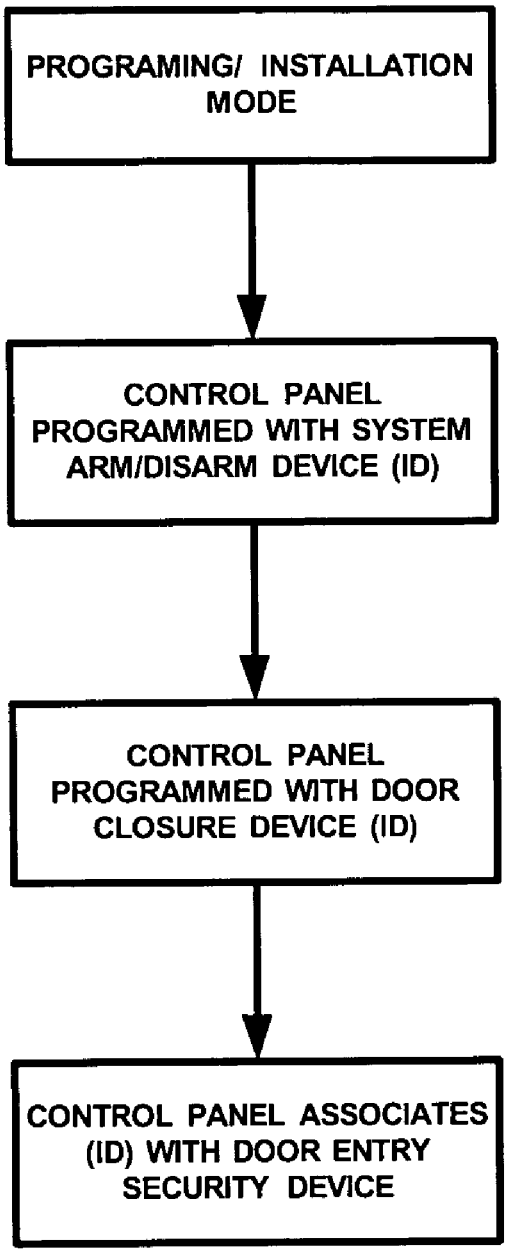
FIG. 6 is a flowchart of the method of programming a control panel under the present invention.

In order for the control panel that has received an alarm message to be able to distinguish a system disarm message from a device such as a keyfob or keypad (and as a result properly disarm the system) from a system disarm message from a door entry security device of this invention (and as a result refuse to disarm the system for the reasons given above), the control panel is programmed with information that will enable it to identify a door entry security device from other system arm/disarm devices such as keyfobs and keypads. With respect to FIG. 6, the door entry security device is installed into the security system by first programming the control panel to accept messages from a system arm/disarm device associated with a particular identification number. In this case, the system arm/disarm device is the lock position detector portion 20 of the door entry security device. Likewise, the control panel is programmed to accept messages from a door closure device associated with the same identification number. In this case, the door closure device is the door position detector portion 22 of the door entry security device. As a result of using the same identification number to identify both the lock position detector portion 20 as well as the door position detector portion 22, the control panel is adapted to register that identification number as being associated with a door entry security device, and will operate accordingly.

Figure 7:
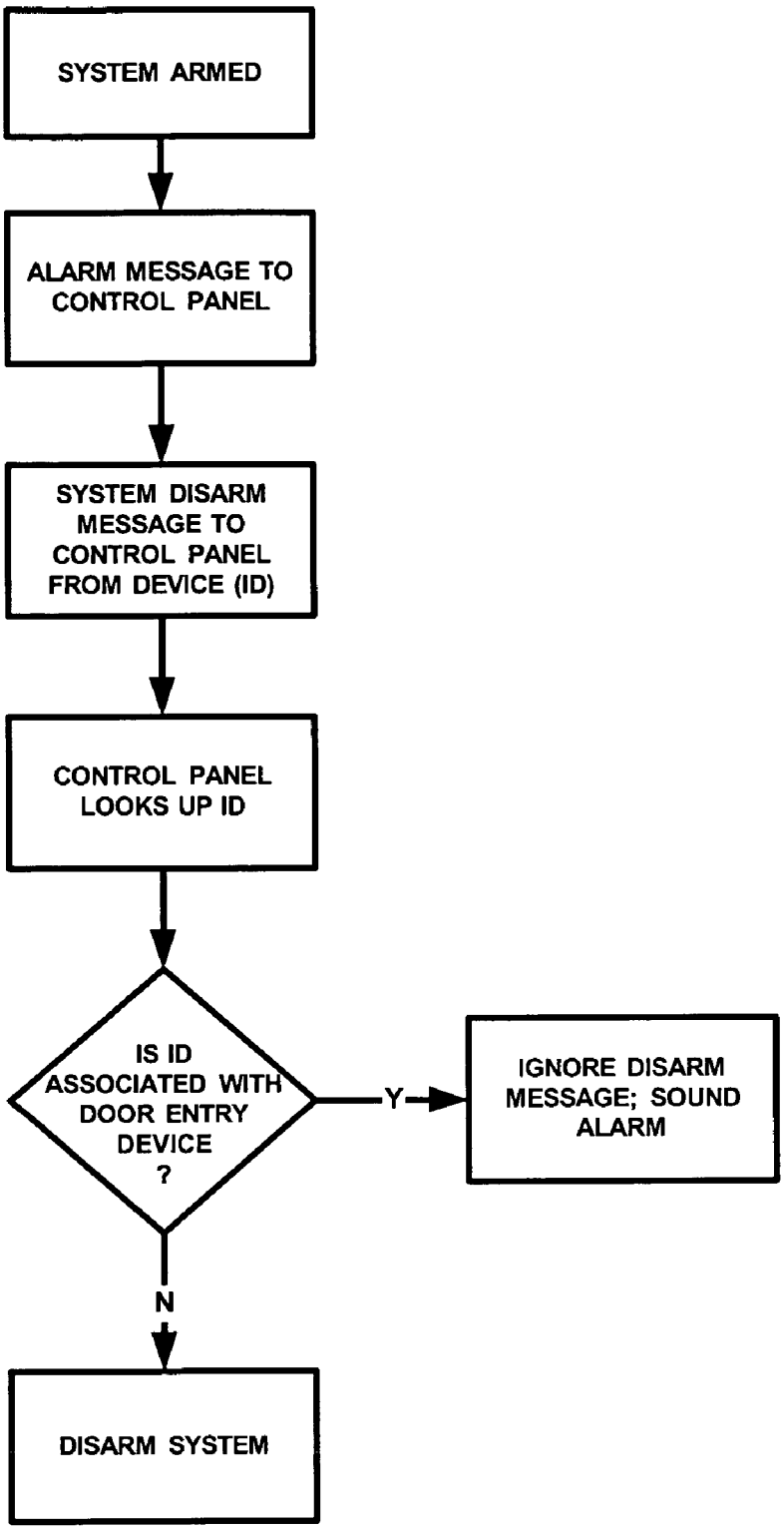
FIG. 7 is a flowchart of the method of operation of a control panel under the present invention.

Referring to FIG. 7, when in an armed state, and the control panel receives an alarm message followed by a system disarm message, the control panel will determine if the system disarm message was received from a system arm/disarm device that was registered as a door entry security device as described above. If the control panel does determine that the system disarm message was received from a system arm/disarm device that was registered as a door entry security device, then the control panel will ignore the disarm message. If, however, the control panel determines that the system disarm message was received from a system arm/disarm device that was not registered as a door entry security device, then the control panel will follow the disarm message and disarm the system.

Figure 5:
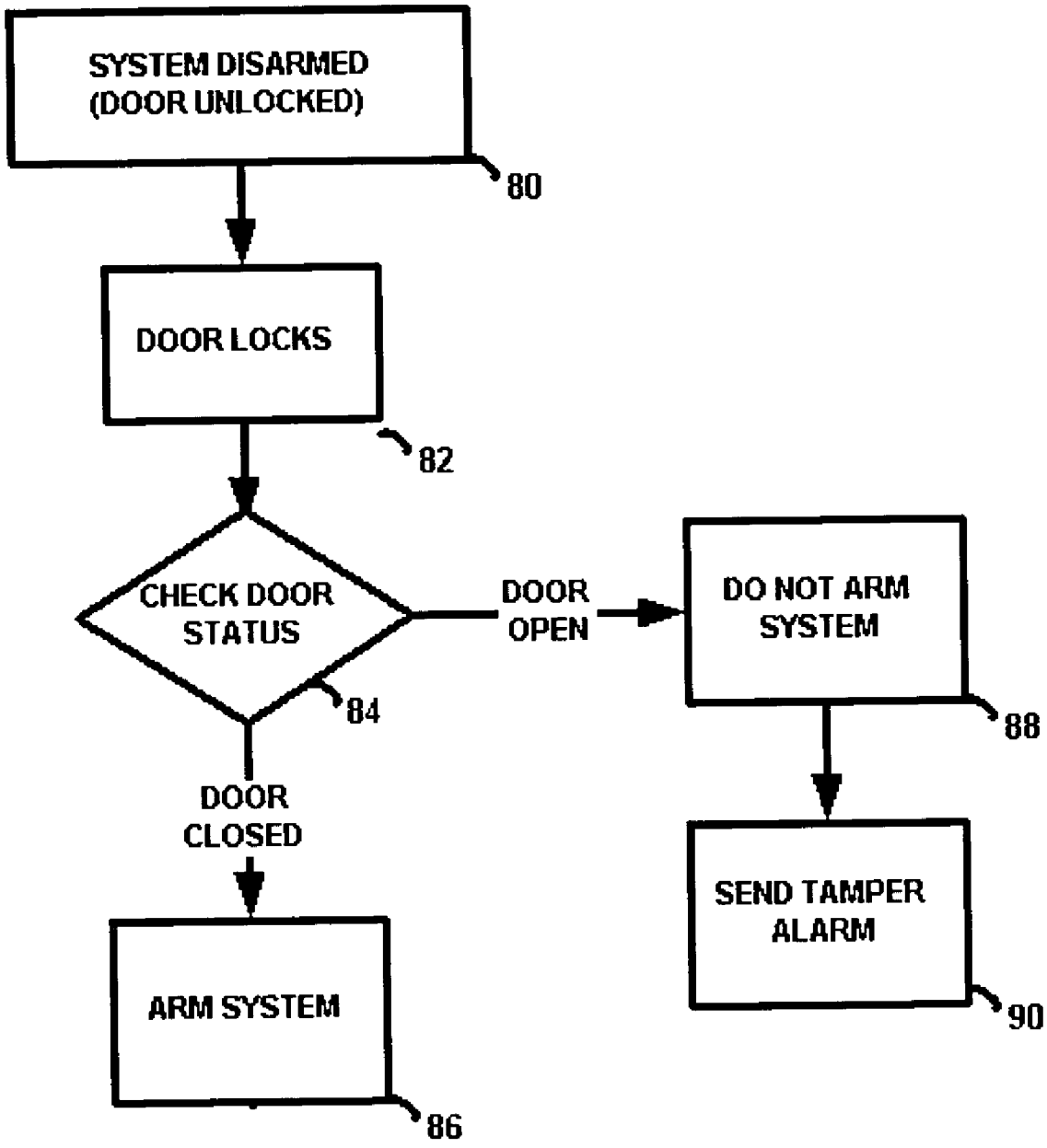
FIG. 5 is a flowchart of the arming operation of the door entry security device.

With respect to FIG. 5, in the next scenario, the system is in the disarmed state (step 80), and the door security lock may be used to arm the system automatically. When the system is disarmed, and the door lock is closed (i.e. the bolt is extended and the DOOR LOCKED signal is generated) (step 82), then the processor will send a system arm message (step 81) to the control panel as long as the door position sensor indicates that the door is in the closed position (DOOR CLOSED) (step 84). That is, if the door is in the open position (DOOR OPEN), the system arm message will not be sent (step 88), since the system should not be armed by the bolt closing when the door is open. This may occur if someone is tampering with the lock position detector switch while the door is open, such as by inserting an object into the bolt cup to falsely trigger the switch. If this occurs, then a tamper alarm message (step 90) is sent to the control panel.

It will be apparent to those skilled in the art that modifications to the specific embodiment described herein may be made while still being within the spirit and scope of the present invention. For example, the door security device is preferably encased within a single housing suitable for retrofit into an existing recess of a doorjamb, but the device may be integrated into a doorjamb, or even into the door itself, in other ways (e.g. multiple housings). Various types of detectors may be used to determine the position of the lock bolt as well as the position of the door with respect to the doorjamb.

What is claimed is:

1. A method of operating a security system comprising the steps of:

a. programming a control panel in the security system to accept messages from a system arm/disarm device associated with an identification number;

b. programming the control panel to accept messages from a door closure device associated with the identification number; and c. the control panel registering the identification number as being associated with a door entry security device.

2. The method of claim 1 further comprising the steps of:

d. the control panel receiving, while in an armed state, an alarm signal from a security device in the security system;

e. a system arm/disarm device transmitting a system disarm message to the control panel; and f. the control panel determining if the system disarm message was received from a system arm/disarm device that has been registered as a door entry security device.

3. The method of claim 2 further comprising the step of:

g. the control panel ignoring the system disarm message from the system arm/disarm device if the control panel determines that the system disarm message was received from a system arm/disarm device that has been registered as a door entry security device.

4. The method of claim 3 wherein there are a plurality of door entry security devices registered at the control panel, each of the door entry security devices being associated with a different identification number, and wherein the control panel determines if the system disarm message was received from any of the system arm/disarm devices that have been registered as a door entry security device; and ignores the system disarm message from the system arm/disarm device if it determines that the system disarm message was received from any of the system arm/disarm devices that have been registered as a door entry security device.

5. The method of claim 4 wherein the control panel follows the system disarm message from the system arm/disarm device if it determines that the system disarm message was not received from any of the system arm/disarm devices that have been registered as a door entry security device.

6. A security system comprising:

a control panel, and a door entry security device comprising:

a housing;

a lock position detecting switch within the housing, adapted to detect the position of a lock mounted on a door associated with a doorjamb as being either locked or unlocked with respect to the doorjamb;

a door position detecting switch within the housing, adapted to detect the position of the door as being either open or closed with respect to the doorjamb and to generate a door status signal that indicates whether the door has been detected as being open or closed;

processing circuitry adapted to generate a security system disarm signal when the lock position detecting switch indicates that the position of the lock has transitioned from a locked state to an unlocked state, the door status signal indicates that the door is closed at the time that a predefined time period has elapsed since the position of the lock is sensed to have transitioned from a locked state to an unlocked state; and the door status signal indicates that the door has been opened after the predefined time period has elapsed; and a data transmitter for sending the security system disarm signal to the control panel; and wherein the control panel comprises processing circuitry adapted to:

accept messages from a system arm/disarm device associated with an identification number;

accept messages from a door closure device associated with the identification number;

register the identification number as being associated with a door entry security device;

receive, while in an armed state, an alarm signal from a security device in the security system;

receive a system disarm message from a system arm/disarm device in the security system;

determine if the system disarm message was received from a system arm/disarm device that has been registered as a door entry security device; and ignore the system disarm message if the system disarm message was received from a system arm/disarm device that has been registered as a door entry security device.

7. The security system of claim 6 further comprising a plurality of door entry security devices, each of the door entry security devices being associated with a different identification number, and wherein the processing circuitry of the control panel is further adapted to determine if the system disarm message was received from any of the system arm/disarm devices that have been registered as a door entry security device; and ignore the system disarm message from the system arm/disarm device if it determines that the system disarm message was received from any of the system arm/disarm devices that have been registered as a door entry security device.

8. The security system of claim 7 wherein the control panel follows the system disarm message from the system arm/disarm device if it determines that the system disarm message was not received from any of the system arm/disarm devices that have been registered as a door entry security device.

* * * * *